US005202209A

United States Patent [19]

Winnik et al.

[11] Patent Number: 5,202,209

[45] Date of Patent: Apr. 13, 1993

[54] TONER AND DEVELOPER COMPOSITIONS WITH SURFACE ADDITIVES

[75] Inventors: Francoise M. Winnik, Toronto; William Riske, Burlington; Anthony R. Davidson, Agincourt; Paul J. Gerroir, Oakville; Richard P. N. Veregin, Mississauga, all of Canada

[73] Assignee: Xerox Corporation, Stamford, Conn.

[21] Appl. No.: 782,949

[22] Filed: Oct. 25, 1991

[51] Int. Cl.[5] ..... G03G 9/083

[52] U.S. Cl. ..... 430/106.6; 430/110

[58] Field of Search ..... 430/106.6, 109, 110, 430/137, 138

[56] References Cited

U.S. PATENT DOCUMENTS

| | | | |
|---|---|---|---|
| 4,338,390 | 7/1982 | Lu | 430/106 |
| 4,394,430 | 7/1983 | Jadwin et al. | 430/110 |
| 4,680,245 | 7/1987 | Suematsu et al. | 430/110 |
| 4,937,157 | 6/1990 | Haack et al. | 430/110 |
| 5,041,351 | 8/1991 | Kitamori et al. | 430/110 |
| 5,080,992 | 1/1992 | Mori et al. | 430/137 |

*Primary Examiner*—John Goodrow
*Attorney, Agent, or Firm*—E. O. Palazzo

[57] ABSTRACT

A toner composition comprised of resin particles, pigment particles, an optional charge enhancing additive component, or components, and a surface additive, or additives comprised of a metal oxide containing a coating thereover of a surfactant.

33 Claims, No Drawings

TONER AND DEVELOPER COMPOSITIONS WITH SURFACE ADDITIVES

BACKGROUND OF THE INVENTION

The invention is generally directed to toner and developer compositions, and more specifically, the present invention is directed to toner compositions containing optional charge enhancing additives, which impart or assist in imparting a positive or negative charge to the toner resin particles and can enable toners with rapid admix characteristics; and surface additives. In one embodiment, there are provided in accordance with the present invention toner compositions comprised of resin particles, pigment particles, a charge additive or charge additives such as quaternary ammonium hydrogen bisulfates, including distearyl methyl hydrogen ammonium bisulfate, orthohalophenylbenzoic acids, aluminum complexes, reference U.S. Pat. No. 4,845,003, and copending patent application U.S. Ser. No. 755,919, the disclosure of which is totally incorporated herein by reference, and as surface additives metal oxides coated with a surfactant to provide, for example, toners with improved flow characteristics and of triboelectrical properties substantially independent of the relative humidity of the environment. In one embodiment, the present invention is directed to toners with surface additives comprised of metal oxides, such as hydrophobic oxides, like tin oxide, with a continuous coating of a surfactant, such as TRITON X-114® which is an octylphenoxy polyethoxy ethanol surfactant, or an AOT® surfactant which is dioctyl sulfosuccinate, sodium salt, available from Aldrich Chemical Company, and wherein the surface additives are particles in a uniform size with a diameter of, for example, from between about 3 to about 100 nanometers and preferably from about 3 to about 50 nanometers as determined by transmission electron microscopy. Also, the aforementioned toner compositions usually contain pigment particles comprised of, for example, carbon black, magnetites, or mixtures thereof, cyan, magenta, yellow, blue, green, red, or brown components, or mixtures thereof thereby providing for the development and generation of black and/or colored images. The toner compositions of the present invention in embodiments thereof possess excellent admix characteristics as indicated herein, and maintain their triboelectric charging characteristics for an extended number of imaging cycles exceeding, for example, 500,000 in a number of embodiments. The toner and developer compositions of the present invention can be selected for electrophotographic, especially xerographic imaging and printing processes, including color processes, such as trilevel and full color process xerography, reference for example copending patent application U.S. Ser. No. 705,995, the disclosure of which is totally incorporated herein by reference.

Toner compositions with surface additives, such as silica like AEROSIL R972®, are known. These additives, which may have a small particle size diameter of 7 to 100 nanometers, may adversely effect the sign, magnitude, and stability of the toner triboelectric charging and wherein the developer charge becomes highly dependent on the relative humidity, disadvantages avoided, or minimized with the invention of the present application. Other disadvantages associated with the prior art surface additives include the high specific gravity of the additives which ranges from about 2.2 grams/cm$^3$ for silica flow additives to about 4 grams/cm$^3$ for titania additives. The additives of the present invention can achieve specific gravities approaching about 1.2 grams/cm$^3$. Reducing the specific gravity of a flow aid, for example, from about 6.95 grams per cm$^3$ for tin oxide produced by the flame hydrolysis process to about 3.2 grams per cm$^3$ for tin oxide selected for the toners of the present invention results in a decrease from about 2.0 to about 0.8 in the weight percent of flow aid needed to achieve superior flow of a toner, since the effectiveness of a flow aid depends on its surface area and not on its mass. Therefore, less flow aid is required, resulting in a lowering of the cost of the toner proportional to the lowering of the mass of the flow aid used in a toner composition. Moreover, a lowering of the amount of flow aids will reduce undesired contamination of other components of a xerographic imaging apparatus, such as the Xerox Corporation 5090®, especially the photoconductive imaging member and the fuser components.

The use of small fumed silica particles of diameter ranging from about 7 to about 100 nanometers for the improvement of toner flow properties is known. These materials such as, for example, AEROSIL 380® available from Degussa, as well as other inorganic oxides, such as for example titania, available from Degussa as DEGUSSA P25® or alumina, available from Degussa as DEGUSSA ALUMINUM OXIDE C®, are invariably produced by a flame hydrolysis process. One disadvantage of the use of such materials is that they are hydrophilic and thus are sensitive to environment humidity, resulting in a decrease in flow and in triboelectric charge of the toner with increasing humidity. For example, a 50 percent decrease in flow and a 50 percent decrease in charge take place as the humidity of the environment reaches 80 percent RH. A well-known process to reduce the humidity sensitivity of these materials is the surface treatment of the inorganic oxides with a functional silane, such as for example hexadimethylsilane, dimethyldichlorosilane, methyltrichlorosilane, and trimethylchlorosilane. Other surface treatments and/or combinations of different inorganic oxides have also been shown in the prior art. For example, Japanese Publication (JP) 61 250,658 discloses mixtures of negatively and positively charging silicas for toner flow improvement, while Japanese Publication 61 249,059 discloses the use of mixtures of hydrophilic and hydrophobic silicas for improved toner flow.

Similarly, Japanese Publication 62 227,140 discloses the use of negative toners coated in a first step with a positive charge additive, such as, for example, alumina treated with an amine-modified silicone oil and in a second step with a negative charge additive, such as, for example, a silica treated with dimethyldichlorosilane, for improved flow. Another surface treatment for silica has been disclosed in U.S. Pat. No. 4,680,245 which illustrates an aminosilane-treated silica for positive charging of toners. The Japanese patent Japanese Publication 62 172,372 discloses the use of a hydrophilic titania treated with a zirconium aluminum coupling agent to obtain negatively charged toners.

The aforementioned surface treatments of inorganic oxides using hydrolyzable silanes or other coupling agents and the application of this treatment for the modification of the surface properties of inorganic oxides produced by the flame hydrolysis process possess a number of disadvantages when selected for toners. One of the disadvantages associated with the use of such surface-treated inorganic oxides is that their use often results in changes in the charging properties of the toner, resulting in an undesirable lowering by, for example, 30 microcoulombs per gram or raising by, for example, 20 microcoulombs per gram of the toner charge. Moreover, the use of these surface-treated additives also results often in a decrease by, for example, 30 percent of the stability of the toner charge particularly under high humidity conditions, for example 85 percent. These and other disadvantages are avoided with the toners of the present invention.

P. Espiard et al., "A Novel Technique for Preparing Organophilic Silica by Water-In-Oil Microemulsions," *Polymer Bulletin*, vol. 24, pages 170 to 173 (Spring 1990), the disclosure of which is totally incorporated herein by reference, discloses a technique for preparing ultramicro spherical silica particles containing vinyl groups on their surfaces by a combination of the sol-gel technique and the water-in-oil emulsion technique in which hydrolysis and condensation of tetraethyl siloxane and trimethoxysilylpropyl methacrylate take place. Spherical silica particles with a size range from 20 to 70 nanometers were obtained and the surface concentrations of the double bonds per square nanometer were from 4 to 7.

H. Yamauchi et al., "Surface Characterization of Ultramicro Spherical Particles of Silica Prepared by W/O Microemulsion Method", *Colloids and Surfaces*, vol. 37, pages 71 to 80 (1989), the disclosure of which is totally incorporated herein by reference, discloses the preparation of ultramicro spherical particles of colloidal silica by the hydrolysis of tetraethoxysilane in the water pool of a water-in-oil (isooctane) microemulsion using Aerosol-OT. The average diameter of the silica spheres obtained was of the order of 10 nanometers and their surface areas were about 100 to 300 square meters per gram. The nitrogen adsorption isotherms of this material indicate that the particles have micropores in contrast to colloidal nonporous silica particles such as AEROSILS ® and those in silica sols having a similar size of particle.

J.C. Giuntini et al., "Sol-gel preparation and transport properties of a tin oxide", *Journal of Materals Science Letters*, vol. 9, pages 1383 to 1388 (1990), the disclosure of which is totally incorporated herein by reference, disclosed a technique for preparing tin alkoxide by hydrolysis of tin butylate to a tin oxide gel.

Also, developer compositions with charge enhancing additives, which impart a positive charge to the toner resin, are well known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents an anionic function including, according to this patent, a variety of conventional anionic moieties such as halides, phosphates, acetates, nitrates, benzoates, methylsulfates, perchloride, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, each other R is a hydrogen or hydrocarbon radical with from 1 to about 8 carbon atoms, and A is an anion, for example, sulfate, sulfonate, nitrate, borate, chlorate, and the halogens such as iodide, chloride and bromide, reference the Abstract of the Disclosure and column 3; a similar teaching is presented in U.S. Pat. No. 4,312,933 which is a divisional of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there is disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014 4,394,430, and 4,560,635 which illustrates a toner with a distearyl dimethyl ammonium methyl sulfate charge additive.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives.

Illustrated in U.S. Pat. No. 4,937,157, the disclosure of which is totally incorporated herein by reference, are toner compositions comprised of resin, pigment, or dye, and tetraalkyl, wherein alkyl, for example, contains from 1 to about 30 carbon atoms, ammonium bisulfate charge enhancing additives such as distearyl dimethyl ammonium bisulfate, tetramethyl ammonium bisulfate, tetraethyl ammonium bisulfate, tetrabutyl ammonium bisulfate, and preferably dimethyl dialkyl ammonium bisulfate compounds where the dialkyl radicals contain from about 10 to about 30 carbon atoms, and more preferably dialkyl radicals with from about 14 to about 22 carbon atoms, and the like. The aforementioned charge additives can be incorporated into the toner or may be present on the toner surface. Advantages of rapid admix, appropriate triboelectric characteristics, and the like are achieved with many of the toners of the aforementioned copending application.

SUMMARY OF THE INVENTION

It is an object of the present invention to provide toner and developer compositions with many of the advantages illustrated herein.

In another object of the present invention there are provided positively charged toner compositions useful for the development of electrostatic latent images including color images.

In yet another object of the present invention there are provided positively charged toner compositions containing quaternary ammonium hydrogen bisulfate, especially trialkyl ammonium hydrogen bisulfate, charge enhancing additives.

In yet another object of the present invention there are provided negatively charged toner compositions containing, for example, metal tetraphenyl borate such as potassium tetraphenyl borate and sodium tetraphenyl borate and metal salicylates, such as the chromium complex of alkyl salicylic acids and the zinc complex of alkyl salicylic acids.

In yet another object of the present invention there are provided toner compositions with surface additives of metal oxides coated with a surfactant to enable toners with improved flow characteristics.

Another object of the present invention resides in providing toner compositions with surface additives to enable toners with suitable flow together with stability of their triboelectric charge with changes in humidity, for example from between about 20 to 80 percent in embodiments.

Another object of the present invention resides in providing colored toner compositions with surface additives with an average diameter of from between about 3 to about 100 nanometers.

In yet a further object of the present invention there are provided humidity insensitive, from about, for example, 20 to 80 percent relative humidity at temperatures of from 60° to 80° F. as determined in a relative humidity testing chamber, toner compositions with desirable admix properties of 5 seconds to 60 seconds as determined by a charge spectrograph, and preferably less than 15 seconds for example, and more preferably from about 1 to about 14 seconds, and acceptable triboelectric charging characteristics of from about 10 to about 40 microcoulombs per gram.

Additionally, in a further object of the present invention there are provided positively charged magnetic toner compositions, and positively charged colored toner compositions containing therein, or thereon quaternary ammonium hydrogen bisulfate, especially trialkyl ammonium hydrogen bisulfate charge enhancing additives or tetraalkyl ammonium sulfonates, such as dimethyl distearyl ammonium sulfonate charge enhancing additives, and surface additives of metal oxides coated with a surfactant.

In another object of the present invention that are provided processes for the preparation of the surface additives.

Another object of the present invention resides in the formation of toners which will enable the development of images in electrophotographic imaging apparatuses, which images have substantially no background deposits thereon, are substantially smudge proof or smudge resistant, and therefore are of excellent resolution; and further, such toner compositions can be selected for high speed electrophotographic apparatuses, that is those exceeding 70 copies per minute.

Another object of the present invention is to provide processes for the preparation of oxides with a specific gravity of from about 1.0 to about 6.0, a value which is less than the specific gravity of similar oxides produced by other methods known in the art.

Yet in another object of the present invention there are provided toner compositions with excellent flow but with reduced loadings of surface additives, for example a reduction of 50 percent in the weight percent loading, compared to toner compositions known in the prior art, such as a toner compositions comprised of 2.7 percent by weight of T-25 titanium oxide obtained from Degussa and 97.3 percent by weight of a toner comprised of 50 percent by weight of styrene and 50 percent by weight of n-butyl methacrylate, 6 percent by weight of REGAL 330® carbon black and 0.5 percent by weight of cetyl pyridinium chloride.

These and other objects of the present invention can be accomplished in embodiments thereof by providing toner compositions comprised of resin particles, pigment particles, optional charge enhancing additives comprised, for example, of quaternary ammonium hydrogen bisulfates, tetra alkyl ammonium sulfonates, distearyl dimethyl ammonium ethyl sulfate, and the like, and surface additives comprised of a metal oxide containing a coating thereover of a surfactant. More specifically, the present invention in one embodiment is directed to toner compositions comprised of resin, pigment, or dye, an optional known charge additive or additives, such as distearyl methyl hydrogen ammonium bisulfate, trimethyl hydrogen ammonium bisulfate, triethyl hydrogen ammonium bisulfate, tributyl hydrogen ammonium bisulfate, didodecyl methyl hydrogen ammonium bisulfate, dihexadecyl methyl hydrogen ammonium bisulfate, and preferably distearyl methyl hydrogen ammonium bisulfate, or mixtures of charge additives, such as the forementioned bisulfates with distearyl dimethyl ammonium methylsulfate, the bisulfates, and charge additives of U.S. Pat. No. 4,937,157 and U.S. Pat. No. 4,904,762 and copending application U.S. Ser. No. 396,497, the disclosures of which are totally incorporated herein by reference, the charge additives of the patents mentioned herein; and the like; and hydrophobic metal oxides with a coating thereover of a surfactant, and wherein the surface additive particles have a diameter of from about 4 to about 100 nanometers and preferably from about 5 to about 30 nanometers. In another embodiment, the present invention is directed to a process for preparing surface additive particles which comprises preparing a mixture of a surfactant and an organic solvent immiscible with water and capable of forming a stable microemulsion with water, adding to the mixture a solution of a hydrolyzing reagent and water to form a microemulsion of water domains within a continuous phase of the organic solvent, and adding to the microemulsion an oil-soluble metal oxide precursor, which reacts with the hydrolyzing agent to form in each water domain a metal oxide particle coated with the surfactant.

In embodiments, the toners can contain charge additives comprised of chromium salicylic acid complexes, cobalt salicylic acid complexes, zinc salicylic acid complexes, nickel salicylic acid complexes and preferably chromium salicylic acid complexes or mixtures thereof, with hydrophobic metal oxides with a coating thereover of a surfactant, and wherein the surface additive particles have a diameter of from between about 4 to about 100 nanometers. Also, charge additives include odium tetraphenyl borate or potassium tetraphenyl borate, and preferably sodium tetraphenyl borate, or mixtures thereof, with hydrophobic metal oxides with a coating thereover of a surfactant, and wherein the surface additive particles have a diameter of from between about 4 to about 100 nanometers.

In another embodiment of the present invention, there are provided, subsequent to known micronization and classification to enable toner particles with an average diameter of from about 5 to about 20 microns, toners comprised of resin particles, pigment particles, and charge enhancing additives; and the surface additives can then be subsequently blended thereon.

Examples of surface additive particles present in effective amounts such as, for example, from between 0.05 to about 1.25 percent by weight of toner and preferably from between 0.1 to about 1.0 percent by weight of toner include hydrophobic oxides, such as titania, zirconia, silica, germanium oxide or mixed oxides, and the like coated with a surfactant. The coating is of an effective thickness of, for example, from about 0.05 nanometer to about 5 nanometers and preferably from about 0.1 to about 2 nanometers. Examples of suitable surfactants include cationic, anionic, or nonionic types. Suitable anionic surfactants include alkyl sulfates of the general structure $R^1OSO^3$ M, where $R^1$ is alkyl with from about 1 to about 25 carbon atoms, such as n-hexyl, n-octyl, n-nonyl, n-decyl, n-undecyl, or n-dodecyl, and M is a cation, such as, for example an alkali metal, like, sodium or potassium cation, alkyl sulfonates of the general structure $R^1SO^3$ M, where $R^1$ is alkyl such as n-hexyl, n-octyl, n-monyl, n-decyl, n-undecyl, or n-dodecyl, and M is a cation, such as for example sodium or potassium cation, aryl sulfates of the general structure $Ar^1OSO^3M$, where $Ar^1$ is an $R^1$ alkyl substituted aryl, such as phenyl, aryl sulfonates of the general structure $Ar^1SO^4M$, where $Ar^1$ is an alkyl substituted aryl, such as phenyl, the alkyl group being represented by $R_1$, dialkylsulfates of the general structure $R_3COOCH_2CHZ—OOC—R_3$, where $R_3$ is n-butyl, n-pentyl, n-hexyl, n-heptyl, or n-octyl and Z is a sulfonate group, dialkylsulfates of the general formula $R_3OCH_2CH(SO_4M)CH_2OR_3$, wherein $R_3$ is alkyl, and the like. Suitable cationic surfactants include alkylammonium salts of the general structure $R_2N+(CH_3)_2X—$, where $R_2$ is n-hexyl, n-octyl, n-nonyl, n-decyl, n-undecyl, n-dodecyl, n-tetradecyl, n-hexadecyl, or n-octadecyl, and X— is a halogen anion such as a chloro or bromo anion, alkylammonium salts of the general formula $R_2NH_2+X—$, where $R_2$ is n-hexyl, n-octyl, n-nonyl, n-decyl, n-undecyl, n-dodecyl, n-tetradecyl, n-hexadecyl, or n-octadecyl, and X— is a halogen anion such as a chloro or bromo anion, alkyl pyridinium salts of the general formula $Ar_2+X—$, where $Ar_2$ is an alkyl substituted pyridinium group, the alkyl group represented by $R_2$, dialkylammonium salts of the general structure $(R2)_2(CH_3)_2N+X—$, dialkylammonium salts of the general formula $(R_2)_2H_2N+X—$, wherein $R_2$ is alkyl and X is a halogen, and the like. Suitable neutral surfactant include compounds of the general formula $Ar_3—O—(CH_2CH_2O)_nH$, where $Ar_3$ is an alkyl substituted phenyl group, the alkyl group belonging to the group represented by $R_2$ or branched alkyl groups such as 1,1,3,3-tetramethylbutyl, and n is a number ranging from about one to about 20, $R_4—O—(CH_2CH_2O)_nH$, where $R_4$ is an alkyl substituted cyclohexyl group, the alkyl group being represented by $R_2$ or branched alkyl groups such as 1,1,3,3-tetramethylbutyl, and n is a number ranging from about one to about 20, $R_2CO—O—(CH_2CH_2O)_nH$, and $R_2$ is alkyl, where n is a number ranging from about one to about 20, glucosides of general structure $R_2$—G, where G is a glucopyranoside substituted at the anomeric position with an alkoxy group of general structure $OR_2$, and wherein $R_2$ is alkyl, thioglucosides of general structure $R_2$—SG, where SG is a thioglucopyranoside substituted at the anomeric position with an alkyl thio group of general structure $SR_2$, and the like. Specific examples of suitable commercial surfactants include those of the TRITON® series available from Rohm and Haas Company, those of the TERGITOL® series available from Union Carbide Corporation, and those of the TEEPOL® series available from Shell Chemical Company.

The surface additives of the present invention can be prepared by the hydrolysis of an oil-soluble metal oxide precursor in stable water-in-oil microemulsions comprised of water, an organic solvent immiscible with water and capable of forming a stable microemulsion in water, a hydrolyzing agent and one or more surfactants. The oil-soluble metal oxide precursor is readily hydrolyzed by the hydrolyzing agent in the water droplets, resulting in the formation of metal oxide particles entrapped within the existing surfactant-coated water droplets. Isolation of the surfactant coated oxide from the microemulsion can be accomplished by a number of known methods, such as precipitation, filtration, and drying.

Examples of suitable organic solvents include aliphatic hydrocarbons, such as n-hexane, n-heptane, n-octane, n-decane, n-dodecane, iso-heptane, iso-octane, isopar-M, cyclopentane, cyclohexane, cycloheptane, methyl-cyclohexane, aromatic hydrocarbons, such as benzene, toluene, o-xylene, m-xylene, p-xylene, ethylbenzene, 1,3,5-trimethylbenzene substituted aromatic hydrocarbons, such as chlorobenzene, bromobenzene, 1-bromonaphthalene. The organic solvent is present in any effective amount; typically, the organic solvent is present with respect to the water in a ratio between about 1 part organic solvent to about 1 part water and about 15 parts organic solvent to about 1 part water, and preferably is present with respect to the water in a ratio between about 3 parts organic solvent to about 1 part water and about 10 parts organic solvent to about 1 parts water, although the organic-to-water ratio can be outside of this range in embodiments.

Examples of suitable oil-soluble metal oxide precursors include tetraalkoxytitanates, tetraalkoxystannates, tetraalkoxyzirconates, tetraalkoxygermanates, tetraalkoxysilanes, and the like. Examples of suitable tetraalkoxytitanates for the process of the present invention include those with from 1 to 18 carbon atoms in the alkyl portion, such as tetramethoxytitanate, tetraethoxytitanate, tetra-n-propoxytitanate, tetra-i-propoxytitanate, tetra-n-butoxytitanate, tetra-s-butoxytitanate, tetrapentoxytitanate, tetra-n-hexyloxytitanate, tetraoctyloxytitanate, tetradecyloxy, titanate tetradodecyloxytitanate, tetraoctadecyloxytitanate, and the like. Examples of suitable tetraalkoxyzirconates for the process of the present invention include those with from 1 to 18 carbon atoms in the alkyl portion, such as tetramethoxyzirconate, tetraethoxyzirconate, tetra-n-propoxyzirconate, tetra-i-propoxyzirconate, tetra-n-butoxyzirconate, tetra-s-butoxy, tetrapentoxyzirconate, tetra-n-hexyloxyzirconate, tetraoctyloxyzirconate, tetradecyloxyzirconate, tetradodecyloxyzirconate, tetraoctadecyloxyzirconate, and the like. Examples of suitable tetraalkoxystannates for the process of the present invention include, those with from 1 to 18 carbon atoms in the alkyl portion, such as tetramethoxystannate, tetraethoxystannate, tetra-n-propoxystannate, tetra-i-propoxystannate, tetra-n-butoxystannate, tetra-s-butoxystannate, tetrapentoxystannate, tetra-n-hexyloxystannate, tetraoctyloxystannate, tetradecyloxystannate, tetradodecyloxystannate, tetraoctadecyloxystannate, and the like. Examples of suitable tetraalkoxy germanates for the process of the present invention include, those with from 1 to 18 carbon atoms in the alkyl portion, such as tetramethoxygermanate, tetraethoxygermanate, tetra-n-propoxygermanate, tetra-i-propoxygermanate, tetra-n-butoxygermanate, tetra-s-butoxygermanate, tetrapentoxygermanate, tetra-n-hexyloxygermanate, tetraoctyloxygermanate, tetradecyloxygermanate, tetradodecyloxygermanate, tetraoctadecyloxygermanate, and the like. Examples of suitable tetraalkoxysilanes for the process of the present invention include those with from 1 to about 6 carbon atoms in the alkyl portion, such as tetramethoxysilane, tetraethoxysilane, tetra-n-propoxysilane, tetra-i-propoxysilane, tetra-n-butoxysilane, tetra-s-butoxysilane, tetra-i-butoxysilane, tetrapentoxysilane, tetrakis-(2-methoxyethoxysilane), and the like. The tetraalkoxysilane is added to the water-in-oil emulsion in any effective amount; typically, the tetraalkoxysilane is present in an amount of from about 1 to about 30 percent by weight of the water phase, and preferably is present in an amount of from about 5 to about 15 percent by weight of the water phase, although the amount can be outside of this range.

Examples of suitable reagents for hydrolyzing the oil-soluble metal oxide precursor include water-soluble bases such as ammonium hydroxide, sodium hydroxide, potassium hydroxide, organic amines such as methyl amine, ethyl amine, and propyl amine, or the like. The hydrolyzing reagent is added to the water-in-oil emulsion in any effective amount; typically, the hydrolyzing reagent is present in an amount of from about 10 to about 60 percent by weight of the water phase, and preferably is present in an amount of from about 20 to about 40 percent by weight of the water phase, although the amount can be outside of this range.

The surface additive particles of the present invention can be prepared by first mixing together the surfactant and the organic solvent (oil phase), followed by adding water to the mixture and stirring until a stable microemulsion is formed. The microemulsion can be formed by stirring or gently shaking the solution at room temperature, although the solution can also be heated or cooled if desired. The microemulsion has completed formation when turbidity disappears from the solution and the solution appears to contain a single phase; the emulsion is microscopic and not visible to the unaided eye. Subsequent to formation of the microemulsion, the oil-soluble metal oxide precursor is added, preferably dropwise, and the microemulsion is stirred until the reaction is complete. The reaction can take place at room temperature, although the microemulsion can also be heated or cooled if desired. The reaction can take place for a period ranging from about 4 hours to about 48 hours. Upon completion of the reaction, the surface additive particles thus formed are recovered from the solution. Recovery can be by any suitable means, such as by adding to the microemulsion a solvent that breaks up the microemulsion, such as acetone, methanol, ethanol, ethyl acetate, butyl acetate, methyl cellosolve, ethyl cellosolve, followed by filtering out the particles that precipitate from the solution, and washing and drying the particles. The surface additive particles can also be recovered by evaporating the solvent to leave the particles as a solid residue, by spray drying, or the like.

Optionally, the surface additive particles of the present invention can be prepared by first mixing together the surfactant and the organic solvent (oil phase), followed by adding to the mixture a solution of a hydrolyzing agent in water and stirring until a stable microemulsion is formed. The microemulsion can be formed by stirring or gently shaking the solution at room temperature, although the solution can also be heated or cooled if desired. The microemulsion has completed formation when turbidity disappears from the solution and the solution appears to contain a single phase; the emulsion is microscopic and not visible to the unaided eye. Subsequent to formation of the microemulsion, the oil-soluble metal oxide precursor is added, preferably dropwise, and the microemulsion is stirred until the reaction is complete. The reaction can take place at room temperature, although the microemulsion can also be heated or cooled if desired. The reaction can be accomplished in a period of from about 4 hours to about 48 hours. Upon completion of the reaction, the surface additive particles thus formed are recovered from the solution. Recovery can be by any suitable means, such as by adding to the microemulsion a solvent that breaks up the microemulsion, such as acetone, methanol, ethanol, ethyl acetate, butyl acetate, methyl cellosolve, ethyl cellosolve, followed by filtering out the particles that precipitate from the solution and washing and drying the particles. The surface additive particles can also be recovered by evaporating the solvent to leave the particles as a solid residue, by spray drying, or the like.

Surface additive particles of the present invention typically have an average particle diameter of from about 3 to about 100 nanometers, and preferably from about 5 to about 50 nanometers, although the average particle diameter can be outside this range. Particle size can be controlled primarily by the ratio of oil to water employed in the microemulsion, although other ingredients in the microemulsion, such as a cosurfactant or cosolvent, can also be present to control drop size provided that they do not inhibit the reaction. Examples of cosolvents include alkyl alcohols, such as methanol, ethanol, n-propanol, n-butanol, n-pentanol, n-hexanol, n-heptanol, or n-octanol, 2-methyl-2-hexanol, and cyclohexanol, alkenols, such as 9-decenol, aryl alcohols, such as 3-phenylpropanol, diols, such as 3-phenoxy-1,2-propanediol. Mixtures of two or more surfactants may be used as long as they satisfy the requirements necessary for microemulsion formation as described, for example, by J. M. Williams, *Langmuir*, 7, 1370 to 1377 (1991) and references therein.

The chemical composition of the surface additives of the present invention can be determined by a number of analytical techniques, including, for example, elemental analysis, thermal gravimetric analysis, Energy Dispersive X-Ray Analysis. Tipically, the particles comprise a metal oxide in an amount of from about 40 to about 95 percent by weight and a surfactant in an amount of from about 5 to about 60 percent by weight, although the amounts can be outside these ranges. The amount of surfactant is controlled primarily by the ratio of surfactant to water employed in the microemulsion, although other factors may be important as well, such as for example the chemical composition and the amount of solvent added to the microemulsion to recover the particles upon completion of the reaction.

Optionally, the surface additives of the present invention can be treated with from about 2 to about 100 weight percent, and preferably from about 5 to about 30 weight percent with a hydrolyzable silane, such as for example hexamethyldisilazane, dimethyl dichlorosilane, methyltrichlorosilane, trimethyl chlorosilane, methyl diethoxysilane, dimethyl dimethoxy silane, trimethyl methoxy silane, and the like. This treatment may be performed, for example, by reaction of the hydrolyzable silane with a dispersion of the additive in a solvent on the surfactant-coated surface additives of the present invention.

The toner compositions of the present invention can be prepared by a number of known methods such as admixing and heating resin particles such as styrene butadiene copolymers, pigment particles such as magnetite, carbon black, or mixtures thereof, and preferably from about 0.5 percent to about 5 percent of the aforementioned charge enhancing additives, or mixtures of charge additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 8 to about 12 microns, which diameters are determined by a Coulter Counter. Subsequently, the toner compositions can be classified utilizing, for example, a Donaldson Model B classifier for the purpose of removing fines, that is toner particles less than about 4 microns volume median diameter. Thereafter, the surface additive of the metal oxide with the surfactant coating is added to the toner by, for example, dry mixing the toner with from about 0.2 to about 2 percent by weight of the metal oxide using a paint shaker, roll-milling the toner and the metal oxide in a bottle containing metal or plastic balls, blending the toner and the metal oxide in a blender equipped with a blade moving at a speed of from about 10 meters per second to about 100 meters per second. Alternatively, the metal oxide and the toner can be dispersed in water, and subsequently, a toner composition can be obtained by drying the resulting suspension by processes such as, for example, air drying or spray drying.

Illustrative examples of suitable toner resins selected for the toner and developer compositions of the present invention include polyamides, polyolefins, styrene acrylates, styrene methacrylate, styrene butadienes, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like. Styrene butadiene copolymers with a styrene content of from about 70 to about 95 weight percent, reference the U.S. patents mentioned herein, the disclosures of which have been totally incorporated herein by reference, can be selected in embodiments. In addition, crosslinked resins, including polymers, copolymers, homopolymers of the aforementioned styrene polymers, may be selected.

As one toner resin, there can be selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of Bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from between about 1,000 to about 6,000 such as polyethylene, polypropylene, and paraffin waxes can be included in, or on the toner compositions as fuser roll release agents.

The resin particles are present in a sufficient, but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive of the present invention may be coated on the pigment particle. When used as a coating, the charge enhancing additive of the present invention is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected providing the objectives of the present invention are achieved.

When the pigment particles are comprised of magnetites, thereby enabling single component toners in some instances, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

Also, there can be included in the toner compositions of the present invention low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention in embodiments are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido)phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative polarity enabling the toner particles, which are positively charged, to adhere to and surround the carrier particles. Alternatively, the carrier particles can be selected from among those having a positive polarity, thus enabling the toner particles, which are negatively charged, to adhere to the carrier surface. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 and preferably about 175 microns thereby permitting them to possess sufficient density and inertia to avoid adherence to the electrostatic images during the development process. The carrier component can be mixed with the toner composition in various suitable combinations, such as from about 1 to about 5 parts per toner to about 100 parts to about 200 parts by weight of carrier.

The toner composition of the present invention can be prepared by a number of known methods including extrusion melt blending the toner resin particles, pigment particles or colorants, and the charge enhancing additive of the present invention as indicated herein, followed by mechanical attrition and classification. Other methods include those well known in the art such as spray drying, melt dispersion, extrusion processing, dispersion polymerization, and suspension polymerization. Also, as indicated herein the toner composition without the charge enhancing additive can be prepared, followed by the addition of surface treated with charge additive colloidal silicas. Further, other methods of preparation for the toner are as illustrated herein.

The toner and developer compositions of the present invention may be selected for use in electrostatographic imaging apparatuses containing therein conventional photoreceptors. Thus, the toner and developer compositions of the present invention can be used with layered photoreceptors that are capable of being charged negatively, such as those described in U.S. Pat. Nos. 4,265,990; 4,584,253; 4,585,884 and 4,563,408, the disclosures of which are totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The following Examples are being supplied to further define various species of the present invention, it being noted that these Examples are intended to illustrate and not limit the scope of the present invention. Parts and percentages are by weight unless otherwise indicated.

EXAMPLE I

Tin Oxide

A. Preparation of Tetra-n-butylstannate

Tin tetrachloride (25 milliliters, obtained from Aldrich Chemical Company) dissolved in dry toluene (200 milliliters) was added over 80 minutes to a solution of n-butanol (156 milliliters, obtained from BDH Chemicals) in dry toluene (300 milliliters) retained under an atmosphere of nitrogen. The mixture was stirred at room temperature, about 25° C., for 2 hours, after which time dry gaseous ammonia was bubbled for from about 15 minutes to about 5 hours into the solution to render it alkaline as determined with a pH sensitive paper. The white suspension that formed was allowed to settle. The supernatant was drawn off by means of a 100 milliliter syringe. Residual toluene solvent was removed by evaporation under vacuum by means of a rotary evaporator. The residual material was dried under high vacuum for 24 hours to yield 46.6 grams (53 percent yield) of tetra-n-butylstannate.

B. Preparation of Coated Tin Oxide

Water (7.5 milliliters) was added to a solution of TRITON X-114® surfactant (10 grams, obtained from Rohm and Haas Company) in cyclohexane (21 milliliters). A thick gel formed immediately. The mixture was stirred at room temperature for 2 hours, after which tetra-n-butylstannate (2.760 grams, obtained from the preparation described in Example I, part A) in cyclohexane (17 milliliters) was added dropwise over a period of 5 minutes. The reaction mixture was stirred overnight (18 hours), after which it was poured into 300 milliliters of acetone, resulting in formation of a fine white flocculate. The flocculate was separated by filtration, washed with acetone, and dried in vacuo at 30° C. for 24 hours to yield 0.57 gram of a white solid. The particle size was 5 nanometers, as measured by transmission electron microscopy. The specific gravity of the sample, which was comprised of tin oxide and TRITON X-114®, was 3.205 grams per $cm^3$ as measured with a Micromeritics Autopycnometer. The specific gravity of a sample of tin oxide produced by a known flame hydrolysis process was 6.95 grams per $cm^3$. In view of the lower specific gravity, 3.205 grams per $cm^3$ of the tin oxide coated with surfactant, it is calculated that a lower amount of tin oxide additive, such as 0.8 percent by weight, can be selected to achieve the same flow properties of the toner composition, compared to that of a toner composition with an amount of 2.0 percent by weight of a tin oxide prepared by a flame hydrolysis process with no surfactant coating.

EXAMPLE II

Tin Oxide

A. Preparation of Tetra-(isopropyl)stannate

Tin tetrachloride (37.5 milliliters, obtained from Aldrich Chemical Company) dissolved in dry toluene (250 milliliters) was added over 10 minutes to a solution of isopropanol (200 milliliters, obtained from Caledon and purified by distillation over magnesium turnings) in dry toluene (500 milliters) kept at 10° C. under an atmosphere of nitrogen. The mixture was stirred at 10° C. for 75 minutes, after which time dry gaseous ammonia was bubbled into the solution to render it alkaline. A white suspension formed. It was allowed to settle. The supernatant was drawn off by means of a double-ended needle. Residual solvent was removed by evaporation under vacuum by means of a rotary evaporator. The residual material was dried under high vacuum for 24 hours to yield 32.2 grams (28 percent yield) of tetra-(isopropyl)stannate.

B. Preparation of Tin Oxide Coated With Surfactant

Water (6.8 milliliters) was added to a solution of AOT® surfactant (32.84 grams, obtained from Aldrich Chemical Company) in toluene (82 milliliters). A thick gel formed immediately. The mixture was stirred at room temperature for 15 minutes, after which tetra-(isopropyl)stannate (8.87 grams, obtained from the preparation described in Example II, part A) in toluene (82 milliliters) was added dropwise over a period of 5 minutes. The reaction mixture was stirred for three days after which it was poured into 8,500 milliliters of acetone resulting in formation of a fine white flocculate. The flocculate was separated by filtration, washed with acetone, and dried in vacuum at 65° C. for 24 hours to yield 5.13 grams of a white-cream colored solid which was comprised of tin oxide and AOT®. The particle size was 4 to 5 nanometers, as measured by transmission electron microscopy. The specific gravity of the product was 4.418 grams per cubic centimeter, as measured with a Micromeritics Autopycnometer. The specific gravity of a sample of tin oxide produced, for example, by flame hydrolysis process was 6.95 grams per cubic centimeter.

EXAMPLE III

Titanium Oxide

Water (11.7 milliliters) was added to a solution of AOT® surfactant (56.5 grams, obtained from Aldrich Chemical Company) in toluene (280 milliliters). A thick gel formed immediately. The mixture was stirred at room temperature for 45 minutes, after which tetra-n-butyl titanate (14.25 milliliters, obtained from Johnson Matthey) was added dropwise over a period of 5 minutes. The reaction mixture was stirred overnight, after which it was poured into 700 milliliters of acetone resulting in formation of a fine light cream colored flocculate. The flocculate was separated by filtration, washed with acetone, and dried in vacuum at 65° C. for 24 hours to yield 9.35 grams of a white-cream colored solid comprised of titanium oxide and AOT®. The particle size was 9 to 10 nanometers as measured by transmission electron microscopy. The specific gravity of the product was 1.464 grams per cubic centimeter, as measured with a Micromeritics Autopycnometer. The specific gravity of a sample of titanium dioxide obtained by the flame hydrolysis process, such as P25 available fron Degussa, was 4.0 grams per cubic centimeter.

EXAMPLE IV

Titanium Oxide

Water (11.7 milliliters) was added to a solution of AOT® surfactant (56.5 grams, obtained from Aldrich Chemical Company) in toluene (280 milliliters). A thick gel formed immediately. The mixture was stirred at room temperature for 45 minutes, after which tetra-n-butyl titanate (14.25 milliliters, obtained from Johnson Matthey) was added dropwise over a period of 5 minutes. The reaction mixture was stirred for eight days at room temperature after which it was poured into 700 milliliters of acetone resulting in formation of a fine light cream colored flocculate. The flocculate was separated by filtration, washed with acetone, and dried in vacuum at 65° C. for 24 hours to yield 12.14 grams of a white-cream colored solid comprised of titanium oxide and AOT®. The particle size was 9 to 10 nanometers, as measured by transmission electron microscopy. The specific gravity of this product was 1.479 grams per cubic centimeter, as measured with a Micromeritics Autopycnometer. The specific gravity of a sample of titanium dioxide obtained by the flame hydrolysis process, such as P25® available from Degussa, was 4.0 grams per cubic centimeter.

EXAMPLE V

Titanium Oxide

Water (82.7 milliliters) was added to a solution of TRITON X-114® surfactant (82.7 grams, obtained from Rohm and Haas) in cyclohexane (425 milliliters). A thick gel formed immediately. The mixture was stirred at room temperature for 45 minutes, after which tetra-n-butyl titanate (29.0 milliliters, obtained from Johnson Matthey) was added dropwise over a period of 5 minutes. The reaction mixture was stirred overnight at room temperature after which it was poured into 1,500 milliliters of acetone resulting in formation of a fine light cream colored flocculate. The flocculate was separated by filtration, washed with acetone, and dried in vacuum at 65° C. for 24 hours to yield 10.83 grams of a white-cream colored solid comprised of titanium oxide and TRITON X-114®. The particle size was 9 to 10 nanometers, as measured by transmission electron microscopy. The specific gravity of the product was 1.980 grams per cubic centimeter, as measured with a Micromeritics Autopycnometer. The specific gravity of a sample of the titanium dioxide obtained by the flame hydrolysis process, such as P25® available from Degussa, was 4.0 grams per cubic centimeter.

EXAMPLE VI

Titanium Oxide

Water (41.8 milliliters) was added to a solution of TRITON X-114® surfactant (41.8 grams, obtained from Rohm and Haas) in cyclohexane (213 milliliters). A thick gel formed immediately. The mixture was stirred at room temperature for 45 minutes, after which tetra-n-butyl titanate (29.5 milliliters, obtained from Johnson Matthey) was added dropwise over a period of 5 minutes. The reaction mixture was stirred overnight at room temperature after which it was poured into 1,700 milliliters of acetone resulting in formation of a fine light cream colored flocculate. The flocculate was separated by filtration, washed with acetone, and dried in vacuum at 65° C. for 24 hours to yield 10.61 grams of a white-cream colored solid comprised of titanium oxide and TRITON X-114®. The particle size was 9 to 10 nanometers, as measured by transmission electron microscopy. The specific gravity of the product was 1.956 grams per cubic centimeter, as measured with a Micromeritics Autopycnometer. The specific gravity of a sample of titanium dioxide obtained by the flame hydrolysis process, such as P25® available from Degussa, was 4.0 grams per cubic centimeter.

EXAMPLE VII

Zirconium Oxide

Water (17.7 milliliters) was added to a solution of TRITON X-114® surfactant (17.7 grams, obtained from Rohm and Haas) in cyclohexane (90 milliliters). A thick gel formed immediately. The mixture was stirred at room temperature for 60 minutes, after which tetra-n-butyl zirconate, butanol complex (16.0 milliliters, obtained from Alfa Company) was added dropwise over a period of 5 minutes. The reaction mixture was stirred overnight at room temperature, after which it was poured into 900 milliliters of acetone, resulting in formation of a fine light cream colored flocculate. The flocculate was separated by filtration, washed with acetone, and dried in vacuum at 65° C. for 24 hours to yield 6.535 grams of a white-cream colored solid comprised of zirconium oxide and TRITON X-114®. The particle size was 4 to 5 nanometers as measured by transmission electron microscopy. The specific gravity of the product sample was 3.809 grams per cubic centimeter, as measured with a Micromeritics Autopycnometer.

EXAMPLE VIII

Zirconium Oxide

Water (35.0 milliliters) was added to a solution of TRITON X-114® surfactant (35.0 grams, obtained from Rohm and Haas) in cyclohexane (180 milliliters). A thick gel formed immediately. The mixture was stirred at room temperature for 60 minutes, after which tetra-n-butyl zirconate, butanol complex (16.0 milliliters, obtained from Alfa Company) was added dropwise over a period of 5 minutes. The reaction mixture was stirred overnight at room temperature, after which it was poured into 900 milliliters of acetone resulting in formation of a fine light cream colored flocculate. The flocculate was separated by filtration, washed with acetone, and dried in vacuum at 65° C. for 24 hours to yield 6.698 grams of a white-cream colored solid comprised of zirconium oxide and TRITON X-114®. The particle size was 4 to 5 nanometers, as measured by transmission electron microscopy. The specific gravity of the product was 2.551 grams per cubic centimeter, as measured with a Micromeritics Autopycnometer.

EXAMPLE IX

Zirconium Oxide

Water (4.55 milliliters) was added to a solution of AOT® surfactant (22.0 grams, dioctyl succinate, sodium salt, obtained from Aldrich Chemical Company) in toluene (110 milliliters). A thick gel formed immediately. The mixture was stirred at room temperature for 90 minutes, after which tetra-n-butyl zirconate, butanol complex (7.4 milliliters, obtained from Johnson Matthey) was added dropwise over a period of 5 minutes. The reaction mixture was stirred for 24 hours at room temperature, after which it was poured into 900 milliliters of acetone resulting in formation of a fine light cream colored flocculate. The flocculate was separated by filtration, washed with acetone, and dried in vacuum at 65° C. for 24 hours to yield 5.21 grams of a white-cream colored solid comprised of zirconium oxide and AOT®. The particle size was 5 nanometers, as measured by transmission electron microscopy. The specific gravity of the product was 1,770 grams per cubic centimeter, as measured with a Micromeritics Autopycnometer.

EXAMPLE X

Zirconium Oxide

Water (4.05 milliliters) was added to a solution of AOT® surfactant (22.0 grams, obtained from Aldrich Chemical Company) in toluene (280 milliliters). A thick gel formed immediately. The mixture was stirred at room temperature for 45 minutes, after which tetra-n-butyl zirconate, butanol complex (7.4 milliliters, obtained from Johnson Matthey) was added dropwise over a period of 5 minutes. The reaction mixture was stirred for eight days at room temperature, after which it was poured into 450 milliliters of acetone resulting in formation of a fine light cream colored flocculate. The flocculate was separated by filtration, washed with acetone, and dried in vacuum at 65° C. for 24 hours to yield 6.87 grams of a white-cream colored solid comprised of zirconium oxide and AOT®. The particle size was 6 to 7 nanometers, as measured by transmission electron microscopy. The specific gravity of the product was 1.733 grams per cubic centimeter as measured with a Micromeritics Autopycnometer.

EXAMPLE XI

Silica

A solution of concentrated ammonium hydroxide (1.8 milliliters, 14 milliliters in water) and water (6.5 milliliters) was added to a solution of AOT® surfactant (40.0 grams, obtained from Aldrich Chemical Company) in toluene (200 milliliters). A thick gel formed immediately. The mixture was stirred at room temperature for 45 minutes, after which tetraethoxysilane (6.8 milliliters, obtained from Aldrich Chemical Company) was added dropwise over a period of 5 minutes. The reaction mixture was stirred for three days at room temperature, after which it was poured into 300 milliliters of acetone resulting in formation of a fine white colored flocculate. The flocculate was separated by filtration, washed with acetone, and dried in vacuum at 65° C. for 24 hours to yield 1.508 grams of a white-cream colored solid comprised of silica and AOT®. The particle size was 14 to 16 nanometers, as measured by transmission electron microscopy.

EXAMPLE X

Silica

A solution of concentrated ammonium hydroxide (18.5 milliliters, 14 milliliters in water) and water (9.3 milliliters) was added to a solution of ALKASURF OP-8® surfactant (28.0 grams, obtained from Alkaril Chemicals Ltd.) in cyclohexane (140 milliliters). A thick gel formed immediately. The mixture was stirred at room temperature for 45 minutes, after which tetraethoxysilane (5.6 milliliters, obtained from Aldrich Chemical Company) was added dropwise over a period of 5 minutes. The reaction mixture was stirred for 24 hours at room temperature, after which it was poured into 300 milliliters of acetone resulting in formation of a fine white colored flocculate. The flocculate was separated by filtration, washed with acetone, and dried in vacuum at 65° C. for 24 hours to yield 1.708 grams of a white-cream colored solid comprised of silica and ALKASURF OP-8®. The particle size was 14 to 16 nanometers as measured by transmission electron microscopy.

EXAMPLE XI

Silica

A solution of concentrated ammonium hydroxide (18.5 milliliters, 14 milliliters in water) and water (9.3 milliliters) was added to a solution of ALKASURF NP-8® surfactant (28.0 grams, obtained from Alkaril Chemicals Ltd.) in cyclohexane (140 milliliters). A thick gel formed immediately. The mixture was stirred at room temperature for 45 minutes, after which tetraethoxysilane (5.6 milliliters, obtained from Aldrich Chemical Company) was added dropwise over a period of 5 minutes. The reaction mixture was stirred for 24 hours at room temperature, after which it was poured into 300 milliliters of acetone resulting in formation of a fine white colored flocculate. The flocculate was separated by filtration, washed with acetone, and dried in vacuum at 65° C. for 24 hours to yield 1.731 grams of a white-cream colored solid comprised of silica and ALKASURF NP-8®. The particle size was 14 to 16 nanometers as measured by transmission electron microscopy.

EXAMPLE XII

Toner Composition

A toner composition was prepared by mixing 10 grams of a toner comprised of 93.5 percent by weight of a resin comprised of 50 percent by weight of styrene and 50 percent by weight of n-butyl methacrylate, 6 percent by weight of REGAL 330® carbon black, and 0.5 percent by weight of cetyl pyridinium chloride with 20 milligrams of the tin oxide with surfactant prepared according to the procedure of Example I in a blender equipped with a blade moving at a speed of 88 m/s for 15 seconds. The final toner composition comprised of 0.2 percent by weight of tin oxide with surfactant and 99.8 percent of toner. The flow of the toner was determined by measuring the percent cohesion of the toner by means of a Hosokawa Micron Powder Characteristics Tester. The percent cohesion is proportional to the fraction of the toner that will not flow under the conditions of the standard test. A lower percent cohesion indicates better flow properties. The cohesion of the resulting toner was 8.3 percent at a relative humidity of 50 percent, as measured by means of a Hosokawa Micron Powder Characteristics Tester. The cohesion of the same toner composition with no tin oxide flow additive measured under the same conditions was 13 percent. The lower cohesion value of the toner treated with the tin oxide with surfactant additive is indicative of a 56 percent improvement in flow, as determined by means of a Hosokawa Micron Powder Characteristics Tester. The cohesion value of a toner of identical composition treated under the same conditions with 0.2 percent by weight of a sample of tin oxide without surfactant with a particle size of 9 nanometers prepared by a flame hydrolysis process was 9.7 percent. This result is indicative of the superior flow of a toner treated with the tin oxide prepared according to the procedure of Example I compared to a toner treated with the same weight percent of tin oxide prepared by the known flame hydrolysis process.

EXAMPLE XIII

Toner Composition

A toner composition was prepared by mixing 10 grams of a toner consisting of 93.5 percent by weight of a resin composed of 50 percent by weight of styrene and 50 percent by weight of n-butyl methacrylate, 6 percent by weight of REGAL 330® carbon black, and 0.5 percent by weight of cetyl pyridinium chloride with 30 milligrams of the tin oxide prepared according to the procedure of Example I in a blender equipped with a blade moving at a speed of 88 m/s for 15 seconds. The flow of the toner was determined by measuring the percent cohesion of the toner by means of a Hosokawa Micron Powder Characteristics Tester. The percent cohesion is proportional to the fraction of the toner that will not flow under the conditions of the standard test. A lower percent cohesion indicates better flow properties. The cohesion of the resulting toner was 6.3 percent at a relative humidity of 50 percent, as measured by means of a Hosokawa Micron Powder Characteristics Tester. The cohesion of the same toner composition with no flow additive measured under the same conditions was 13 percent. The lower cohesion value of the toner treated with the metal oxide and surfactant additive is indicative of a 100 percent improvement in toner flow, as determined by means of a Hosokawa Micron Powder Characteristics Tester.

EXAMPLE XIV

Toner Composition

A toner composition was prepared by mixing 10 grams of a toner consisting of 93.5 percent by weight of a resin composed of 50 percent by weight of styrene and 50 percent by weight of n-butyl methacrylate, 6 percent by weight of REGAL 330® carbon black, and 0.5 percent by weight of cetyl pyridinium chloride with 80 milligrams of the tin oxide prepared according to the procedure of Example II in a blender equipped with a blade moving at a speed of 88 m/s for 15 seconds. The cohesion of the resulting toner was 7.1 percent at a relative humidity of 50 percent, as measured by means of a Hosokawa Micron Powder Characteristics Tester. The cohesion of the same toner composition with no flow additive measured under the same conditions was 13 percent. The lower cohesion value of the toner treated with the metal oxide and surfactant additive is indicative of a 85 percent improvement in toner flow as determined by means of a Hosokawa Micron Powder Characteristics Tester.

EXAMPLE XV

A developer composition was prepared by admixing for 15 minutes 1 gram of a toner comprised of 0.2 percent by weight of tin oxide on the surface prepared according to the procedure described in Example I and 99.8 percent of a toner comprised of 90 percent by weight of a resin composed of 50 percent by weight of styrene and 50 percent by weight of n-butyl methacrylate, and 10 percent by weight of RAVEN 5750® carbon black with 49.0 grams of a carrier comprised of 100 microns (average diameter) ferrite particles coated with a terpolymer consisting of 81 percent by weight of methyl methacrylate, 14 percent by weight of styrene, and 5 percent by weight of vinyl triethoxysilane. There resulted on the toner composition a negative triboelectric charge of 27.5 microcoulombs per gram. The triboelectric charge of an untreated toner charged under the same conditions was −26.4 microcoulombs per gram. This result indicates that the tin oxide additive does not modify significantly the triboelectric charge of the toner composition to which it is added in an amount sufficient for marked improvement in the flow properties of the toner as indicated, for example, in Example XIII.

EXAMPLE XVI

A developer composition was prepared by admixing for 15 minutes 1 gram of a toner composed of 0.2 percent by weight of tin oxide prepared according to the procedure described in Example II and 99.8 percent of a toner consisting of 90 percent by weight of a resin composed of 50 percent by weight of styrene and 50 percent by weight of n-butyl methacrylate, and 10 percent by weight of RAVEN 5750® carbon black with 49.0 grams of a carrier consisting of 100 microns of ferrite particles coated with a terpolymer consisting of 81 percent by weight of methyl methacrylate, 14 percent by weight of styrene, and 5 percent by weight of vinyl triethoxysilane. There resulted on the toner composition a negative triboelectric charge of 26.3 microcoulombs per gram. The tribolectric charge of an untreated toner charged under the same conditions was −26.4 microcoulombs per gram.

Other modifications of the present invention may occur to those skilled in the art subsequent to a review of the present application, and these modifications, including equivalents thereof, are intended to be included within the scope of the present invention.

What is claimed is:

1. A toner composition consisting essentially of resin particles, pigment particles, an optional charge enhancing additive component, or components, and a surface additive, or additives comprised of a metal oxide containing a coating thereover of a surfactant; and wherein said additives have a particle diameter of from about 4 to about 100 nanometers, and which additives are prepared by mixing said surfactant and an organic solvent immiscible with water to form a stable microemulsion with water; adding to the mixture formed a solution of a hydrolyzing reagent and water to form a microemulsion of water domains within a continuous phase of the organic solvent; and adding to the microemulsion an oil soluble metal oxide precursor which reacts with the hydrolyzing agent to form in the water domains a metal oxide coated with said surfactant, and wherein said toner particles possess improved flow characteristics and which toner particles have triboelectric characteristics substantially independent of the relative humidity.

2. A toner in accordance with claim 1 wherein the charge additive is comprised of quaternary ammonium hydrogen bisulfates, tetraalkyl ammonium sulfonates, distearyl dimethyl ammonium ethyl sulfate, of mixtures thereof.

3. A toner composition consisting essentially of resin, and pigment, a charge additive comprised of distearyl methyl hydrogen ammonium bisulfate, trimethyl hydrogen ammonium bisulfate, triethyl hydrogen ammonium bisulfate, tributyl hydrogen ammonium bisulfate, didodecyl methyl hydrogen ammonium bisulfate, dihexadecyl methyl hydrogen ammonium bisulfate, or mixtures thereof, and a surface additive comprised of a hydrophobic metal oxide with a coating thereover of a surfactant, and wherein the surface additive particles have a diameter of from between about 4 to about 100 nanometers; and wherein said additives have a particle diameter of from about 4 to about 100 nanometers, and which additives are prepared by mixing said surfactant and an organic solvent immiscible with water to form a stable microemulsion with water; adding to the mixture formed a solution of a hydrolyzing reagent and water to form a microemulsion of water domains within a continuous phase of the organic solvent; and adding to the microemulsion an oil soluble metal oxide precursor which reacts with the hydrolyzing agent to form in the water domains a metal oxide coated with said surfactant, and wherein said toner particles possess improved flow characteristics and which toner particles have triboelectric characteristics substantially independent of the relative humidity.

4. A toner in accordance with claim 3 wherein the surfactant is present in an amount of from between about 0.05 to about 1.25 percent.

5. A toner in accordance with claim 3 wherein the metal oxide is titanium dioxide, zirconium oxide, tin oxide, silicon dioxide, germanium oxide, or mixtures thereof.

6. A toner in accordance with claim 5 wherein the coating is of a thickness of from about 0.05 nanometer to about 5 nanometers.

7. A toner composition in accordance with claim 3 wherein the specific gravity of the metal oxide coated with surfactant is from about 10 to about 60 percent lower than that of the corresponding metal oxide without a surfactant.

8. A toner in accordance with claim 1 wherein the surfactant is cationic, anionic, nonionic, or mixtures thereof.

9. A toner in accordance with claim 1 wherein the surfactant is an alkyl sulfate.

10. A toner in accordance with claim 1 wherein the surfactant is an octylphenoxy polyethoxy ethanol.

11. A toner in accordance with claim 1 wherein the surfactant is dioctyl sulfosuccinate sodium salt.

12. A toner in accordance with claim 1 wherein the pigment particles are comprised of carbon black or magnetite.

13. A toner in accordance with claim 1 wherein the pigment particles are comprised of cyan, magenta, yellow, brown, red, blue, green, or mixtures thereof.

14. A toner in accordance with claim 3 wherein the surfactant is octylphenoxy polyethoxy ethanol.

15. A toner in accordance with claim 3 wherein the surfactant is a dioctyl sulfosuccinate sodium salt.

16. A toner in accordance with claim 3 wherein the pigment particles are comprised of carbon black, or magnetite.

17. A toner in accordance with claim 3 wherein the pigment particles are comprised of cyan, magenta, yellow, brown, red, blue, green, or mixtures thereof.

18. A developer composition comprised of the toner of claim 1 and carrier particles.

19. A developer composition comprised of the toner of claim 2 and carrier particles.

20. A developer composition comprised of the toner of claim 3 and carrier particles.

21. A developer composition in accordance with claim 18 wherein the carrier particles include a polymeric coating thereover.

22. A developer composition in accordance with claim 19 wherein the carrier particles include a polymeric coating thereover.

23. A developer composition in accordance with claim 19 wherein the carrier particles include a mixture of polymeric coatings thereover.

24. A developer composition in accordance with claim 19 wherein the carrier particles include a mixture of polymeric coatings thereover comprised of polyvinylidene fluoride and polymethylmethacrylate.

25. A toner composition in accordance with claim 3 wherein the charge additive is comprised of a chromium salicylic acid complex, a cobalt salicylic acid complex, a zinc salicylic acid complex, a nickel salicylic acid complex, or mixtures thereof.

26. A toner composition in accordance with claim 3 wherein the charge additive is comprised of a sodium tetraphenyl borate or potassium tetraphenyl borate.

27. A toner composition in accordance with claim 1 wherein the resin particles are comprised of styrene polymers.

28. A toner composition in accordance with claim 1 wherein the resin particles are comprised of styrene acrylates, styrene methacrylates, styrene butadienes, or polyesters.

29. A toner composition in accordance with claim 2 wherein the resin particles are comprised of styrene acrylates, styrene methacrylates, styrene butadienes, or polyesters.

30. A toner composition in accordance with claim 3 wherein the resin is comprised of styrene acrylates, styrene methacrylates, styrene butadienes, or polyesters.

31. A toner in accordance with claim 3 wherein the surfactant is octyl phenoxy polyethoxy ethanol and the oxide is tin oxide obtained from a tetrabutyl stannate.

32. A toner in accordance with claim 3 wherein the surfactant is dioctyl sulfosuccinate sodium salt and the oxide is tin oxide obtained from a tetraisopropyl stannate.

33. A toner in accordance with claim 15 wherein the oxide is titanium oxide, zirconium oxide, or silicon oxide.

* * * * *